US010364650B2

(12) United States Patent
Wood

(10) Patent No.: US 10,364,650 B2
(45) **Date of Patent: *Jul. 30, 2019**

(54) MULTI-STAGE HYDRAULIC FRACTURING TOOL AND SYSTEM

(71) Applicant: 2054351 ALBERTA LTD., Calgary (CA)

(72) Inventor: Blake Wood, Calgary (CA)

(73) Assignee: 2054351 ALBERTA LTD, Calgary (CA)

( * ) Notice: Subject to any disclaimer, the term of this patent is extended or adjusted under 35 U.S.C. 154(b) by 7 days.

This patent is subject to a terminal disclaimer.

(21) Appl. No.: 15/622,581

(22) Filed: Jun. 14, 2017

(65) Prior Publication Data

US 2018/0230775 A1 Aug. 16, 2018

Related U.S. Application Data

(60) Provisional application No. 62/486,129, filed on Apr. 17, 2017, provisional application No. 62/458,764, filed on Feb. 14, 2017.

(51) Int. Cl.
*E21B 34/14* (2006.01)
*E21B 34/00* (2006.01)

(52) U.S. Cl.
CPC ..... *E21B 34/14* (2013.01); *E21B 2034/007* (2013.01)

(58) Field of Classification Search
CPC ..... E21B 34/14; E21B 34/10
See application file for complete search history.

(56) References Cited

U.S. PATENT DOCUMENTS 5,479,986 A 1/1996 Gano et al.
6,907,936 B2 6/2005 Fehr et al.
(Continued)

FOREIGN PATENT DOCUMENTS

CA 2735402 10/2011
CA 2927850 7/2016
WO 2016172791 11/2016

OTHER PUBLICATIONS

Packers Plus 2012 StackFRAC Animation (with voiceover)—YouTube https://youtu.be/PU1BnEGGsqY, Published on Jun. 23, 2012.

(Continued)

*Primary Examiner* — Kristyn A Hall
(74) *Attorney, Agent, or Firm* — MBM Intellectual Property Law LLP

(57) ABSTRACT

The invention relates to a multi-stage hydraulic fracturing tool and system for controllably exposing selected locations along a wellbore to a pressurized fluid. The system comprises an elongated casing (for disposal within the wellbore) defining an internal borehole extending longitudinally, and having one or more ports; an actuation member configured for travelling down the borehole and includes a wedged portion and a groove having a first length in the longitudinal direction, formed at least partially circumferentially around an outer surface of the actuation member, a sliding sleeve member having an aperture for receiving the actuation member, and one or more inward-facing protrusions having a length less than or equal to the first length, connected to the sliding sleeve member and at least initially protruding radially into the aperture.

20 Claims, 16 Drawing Sheets

(56) References Cited

U.S. PATENT DOCUMENTS

| | | | | |
|---|---|---|---|---|
| 7,325,617 | B2 | 2/2008 | Murray | |
| 7,798,236 | B2 | 9/2010 | McKeachnie et al. | |
| 8,231,947 | B2 | 7/2012 | Vaidya et al. | |
| 8,863,853 | B1 | 10/2014 | Harris et al. | |
| 9,840,892 | B2 | 12/2017 | Nordheimer | |
| 2003/0173089 | A1 | 9/2003 | Westgard et al. | |
| 2005/0205266 | A1 | 9/2005 | Todd et al. | |
| 2007/0181224 | A1 | 8/2007 | Marya et al. | |
| 2011/0048743 | A1 | 3/2011 | Stafford | |
| 2015/0096767 | A1* | 4/2015 | Atilano | E21B 34/14 166/383 |

OTHER PUBLICATIONS

Non-Final Office Action dated Oct. 9, 2018, for U.S. Patent Publication No. US 2018-0230774 A1.

* cited by examiner

MULTI-STAGE HYDRAULIC FRACTURING TOOL AND SYSTEM

FIELD

The present invention pertains to the field of hydraulic fracturing in general and in particular to multi-stage hydraulic fracturing involving controlled exposure of selected locations along a wellbore to create multiple fracture treatments from a wellbore.

BACKGROUND

Hydraulic fracturing ("fracking") and multi-stage hydraulic fracturing are methods used to increase the economic viability of the production of oil and gas wells. Hydraulic fracturing to extract oil and natural gas involves injecting pressurized fluid and proppant through the wellbore down to and into the reservoir that contains the hydrocarbons, in order to propagate fissures in the rock layers. By this process the fissures are filled with proppant, and become the paths by which the oil and gas flow out of the rock layers and into the wellbore system. Several methods of hydraulic fracturing have been utilized.

The plug and perforate, often termed 'plug and perf', version of multistage hydraulic fracturing is the oldest and employs the use of wireline plugs, in conjunction with cement, to isolate between stages and wireline perforating guns to gain access to the reservoir rock.

In the plug and perforate method, casing is first installed and cemented over the reservoir zone and to surface. To initiate a frack, the frack plug is attached below perforating guns and the entire assembly is run to the bottom of the wellbore on wireline. The frack plug is set in the casing and then released. The perforating gun assembly is then pulled up to a shallower depth in the wellbore. The perforating gun charges are activated creating holes through the casing and allowing the wellbore to have fluid communication with the reservoir at the perforation point(s). The assembly is pulled out of the wellbore and the pumping of the fracture treatment into the newly perforated interval can begin. After treatment of the zone, a new plug and perforating guns are run into the wellbore to a shallower depth than the last perforations and previously stimulated zone. The process is then repeated. Typically after all zones are stimulated, the frack plugs must be milled out using a coiled tubing unit before hydrocarbon production can commence.

The consequence of the requirement for a coiled tubing unit in the plug and perforate method of hydraulic fracturing means that the horizontal and productive section of the wellbores can only be a limited length due to the frictional reach constraints of coiled tubing pipe. Recently there have been attempts to improve the multistage stage ball activated sliding sleeve ball drop style system. For example, TMK Completions Ltd. discloses an "infinite" stage system based on an electrical "counting" mechanism.

One current technology, often termed 'ball activated sliding sleeve' systems, in this field involves the sliding sleeve ball drop method which uses a graduated ball size functionality. This process involves first installing a production casing or liner having ports, which are covered with sliding sleeves. Each sleeve has a ball seat of a different and gradually larger size. To pump a fracture treatment, a ball is dropped into the wellbore and is pumped down to its corresponding size of ball seat where it lands and forms a seal. Pressure is increased in the upper portion of the wellbore above the seated ball until a shear member in the sleeve shears from the pressure differential, causing the now free sliding sleeve to move deeper into the wellbore and exposing a now opened port between the wellbore and the reservoir. The fracture treatment is then pumped through that port until completed. Then the next larger ball is dropped which would land and seal at the next shallowest stage. The process repeated until all desired stages have been opened and fracked. Each fracturing stage is isolated from the one below it with a slightly larger ball. The system has a finite number of stages because the size of the balls eventually increases to a size that is too large to be pumped down the wellbore. The major drawback to this method is that the number of stages is limited by the diameter of the casing, which limits the number of balls used, and in turn the number stages that can be fracked.

Other technologies related to ball-activated sliding sleeve systems are described for example in U.S. Pat. Nos. 6,907,936 and 8,863,853.

Canadian Patent Application No. 2,927,850 discloses a system for successively uncovering a plurality of contiguous ports in a tubing liner within a wellbore, or for successively uncovering individual groups of ports arranged at different but adjacent locations along the liner, to allow successive fracking of the wellbore at such locations. Sliding sleeves in the tubing liner are provided, having a circumferential groove therein, which are successively moved from a closed position covering a respective port to an open position uncovering such port by an actuation member placed in the bore of the tubing liner. Each actuation member comprises a dissolvable plug which in one embodiment is retained by shear pins at an uphole end of a collet sleeve, the latter having radially-outwardly biased protuberances (fingers) which matingly engage sliding sleeves having cylindrical grooves therein, based on the width of the protuberance. In one embodiment, when actuating the most downhole sleeve, the shear pin shears allowing the plug to move in the collet sleeve and prevent the protuberance (fingers) from disengaging. The working of the tool described in the '850 patent application require a plug of undesirably long length and profile, which makes the plug difficult to load into the wellhead at surface. It takes more time and requires extra equipment, thereby adding to the overall cost of the process. Moreover, the presence of groove in the sliding sleeve in the tool/system of the '850 patent can fill with sand and prevent an actuation member engagement.

Therefore, there is a need for a system for multistage hydraulic fracturing that is not subject to one or more limitations of the prior art.

This background information is provided to reveal information believed by the applicant to be of possible relevance to the present invention. No admission is necessarily intended, nor should be construed, that any of the preceding information constitutes prior art against the present invention.

SUMMARY

In accordance with embodiments of the invention, there is provided a multi-stage hydraulic fracturing tool and system. According to one embodiment, there is provided a system for controllably exposing selected locations along a wellbore to a pressurized fluid. The system comprises an elongated casing for disposal within the wellbore, the casing defining an internal borehole extending longitudinally with the wellbore, the casing having one or more ports extending through the casing; an actuation member configured for travelling down the borehole in a longitudinal direction, the actuation member including a wedged portion and a groove formed at least partially circumferentially around an outer surface of the actuation member, the groove having a first length in the longitudinal direction; a sliding sleeve member for disposal within the borehole and having an aperture for receiving the actuation member therein, the sliding sleeve member configured to initially cover the port (e.g. using shear pins), and further configured to move downhole in the longitudinal direction, thereby uncovering the port upon application of a force in the longitudinal direction; and one or more inward-facing protrusions connected to the sliding sleeve member, the protrusions at least initially protruding radially into the aperture, the protrusions having a second length in the longitudinal direction, the second length being less than or equal to the first length, one or both of the protrusions and the groove configured, upon alignment of the protrusions and the groove, to move radially toward the other due to a biasing force so that the protrusions are received within the groove, whereupon a radially oriented face of the groove engages respective radially oriented faces of each of the one or more protrusions to transfer the force from the actuation member to the sleeve member, wherein the biasing force is generated by one or both of: resilient radial outward deformation of a deformation region of the sliding sleeve member, the deformation region including the protrusions; and resilient radial inward deformation of the actuation member, said resilient radial outward and inward deformation occurring in response to action of the wedged portion on the protrusions during downhole motion of the actuation member past the protrusions.

BRIEF DESCRIPTION OF THE FIGURES

Further features and advantages will become apparent from the following detailed description, taken in combination with the appended drawing, in which.

DETAILED DESCRIPTION

Embodiments of the present invention provide for a multi-stage hydraulic fracturing tool. The tool generally includes a casing having one or more ports, one or more actuation members which travel down a borehole, and one or more sliding sleeves which initially cover some of the ports and are movable using a mating actuation member to uncover those ports.

In the following paragraphs, embodiments will be described in detail by way of example with reference to the accompanying drawings, which are not drawn to scale, and the illustrated components are not necessarily drawn proportionately to one another. Throughout this description, the embodiments and examples shown should be considered as exemplars, rather than as limitations of the present disclosure.

Figure 1:
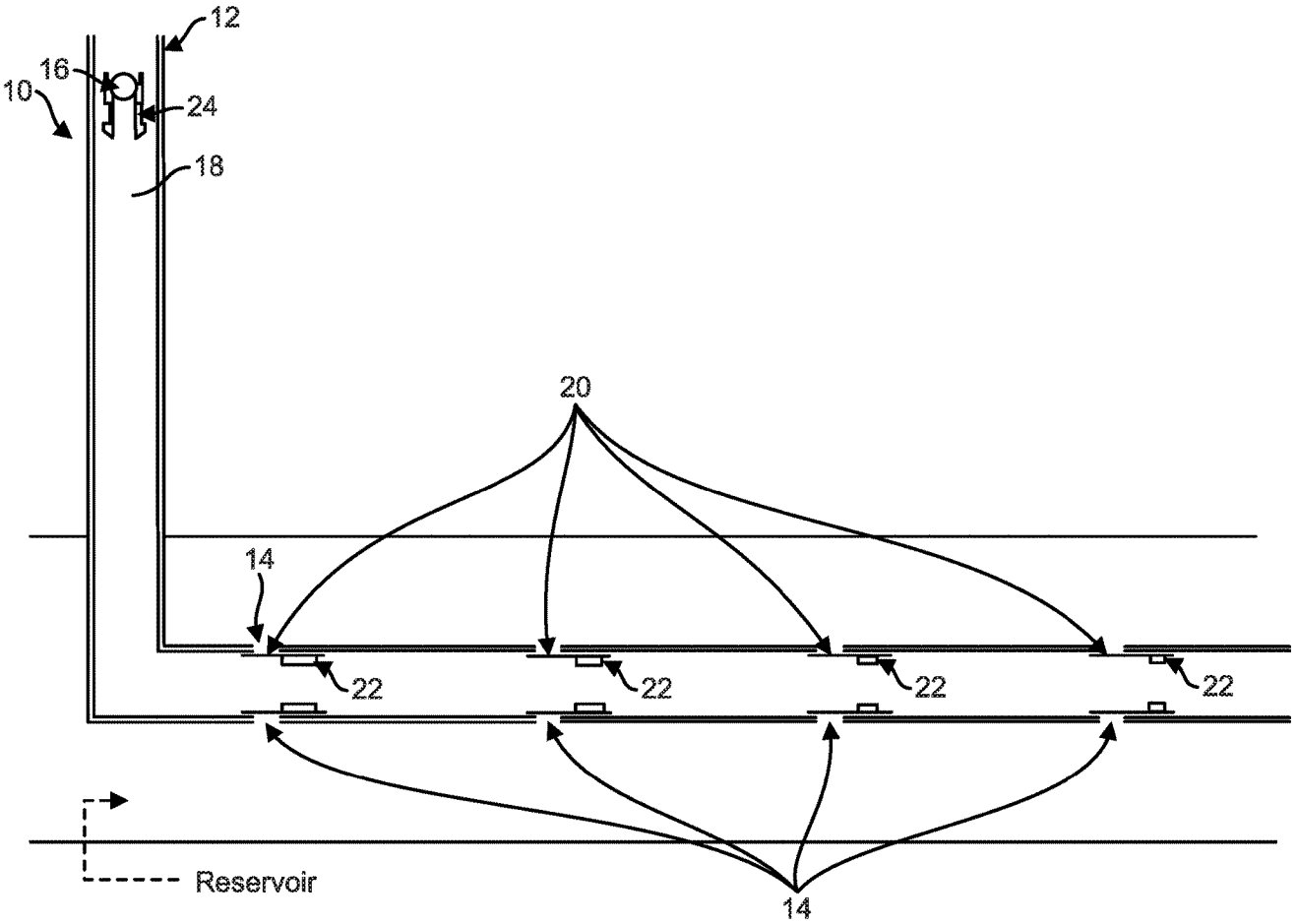
FIG. 1 illustrates, in a sectional view, a tool in accordance with an embodiment of the present invention in a wellbore.

FIG. 1 illustrates a wellbore 10 and a casing 12 included in the wellbore, and having a plurality of ports 14 located along the length of the casing. An actuation member 16 according to the present invention is placed within a borehole 18 which is defined by the inner sidewalk of the casing, and travels (under hydraulic pressure) through the borehole in the downhole direction. Multiple sliding sleeve members 20 according to the present invention are shown which initially cover the various ports 14. The sliding sleeve members include protrusions 22 of varying lengths, and the actuation member 16 includes a groove 24 (radial keyway) of a given length. The actuation member 16 travels down the borehole until it reaches a sliding sleeve member 20 having protrusions 22 which are equal to or shorter in (longitudinal) length than the corresponding groove in the actuation member. At this point the protrusions matingly fit within the groove 24 of the actuation member 16. This mating allows downhole force to be applied to the sliding sleeve member in order to move it downhole, thereby uncovering the associated ports.

The casing can be viewed as a structure within the wellbore which is relatively impermeable to hydraulic fracking fluid. The casing can be formed of one or more mating sections of selected materials.

Figure 2:
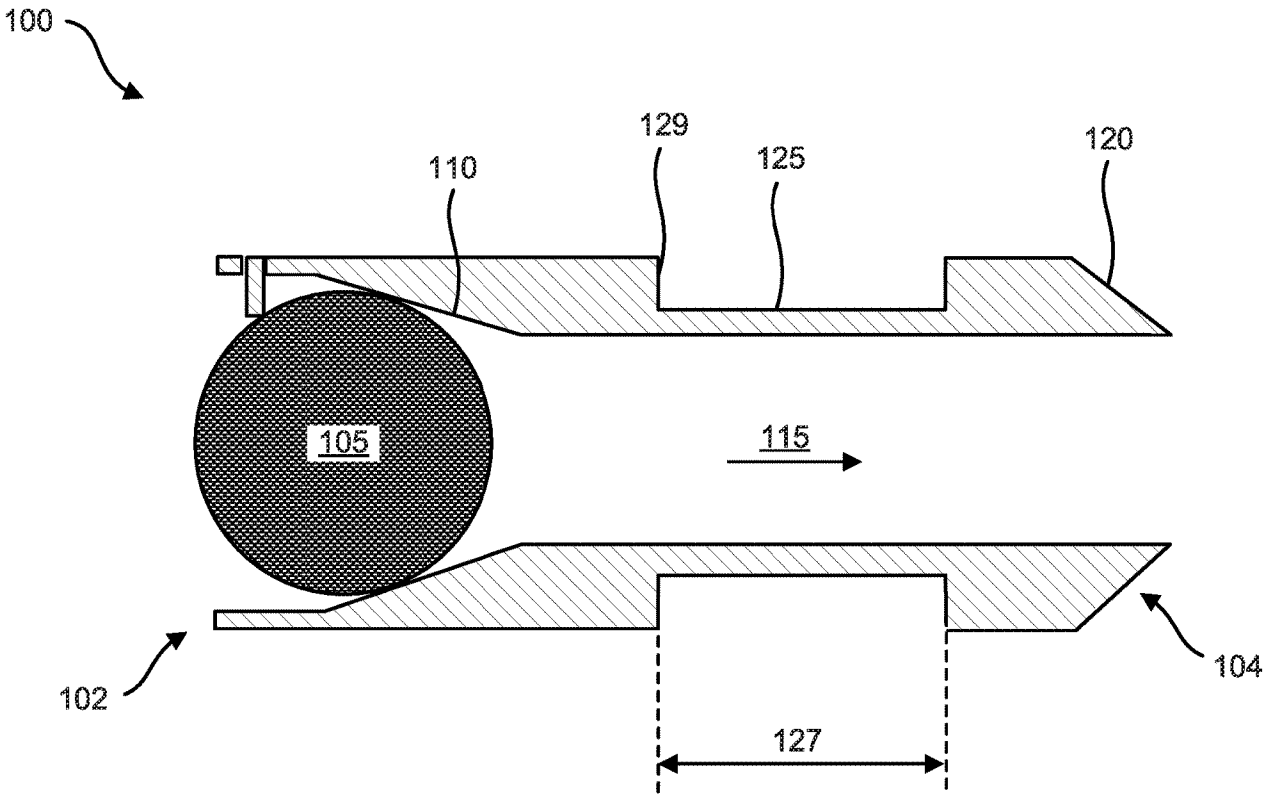
FIG. 2 illustrates, in a cross sectional view, an actuation member in accordance with an embodiment of the present invention.
Figure 3:
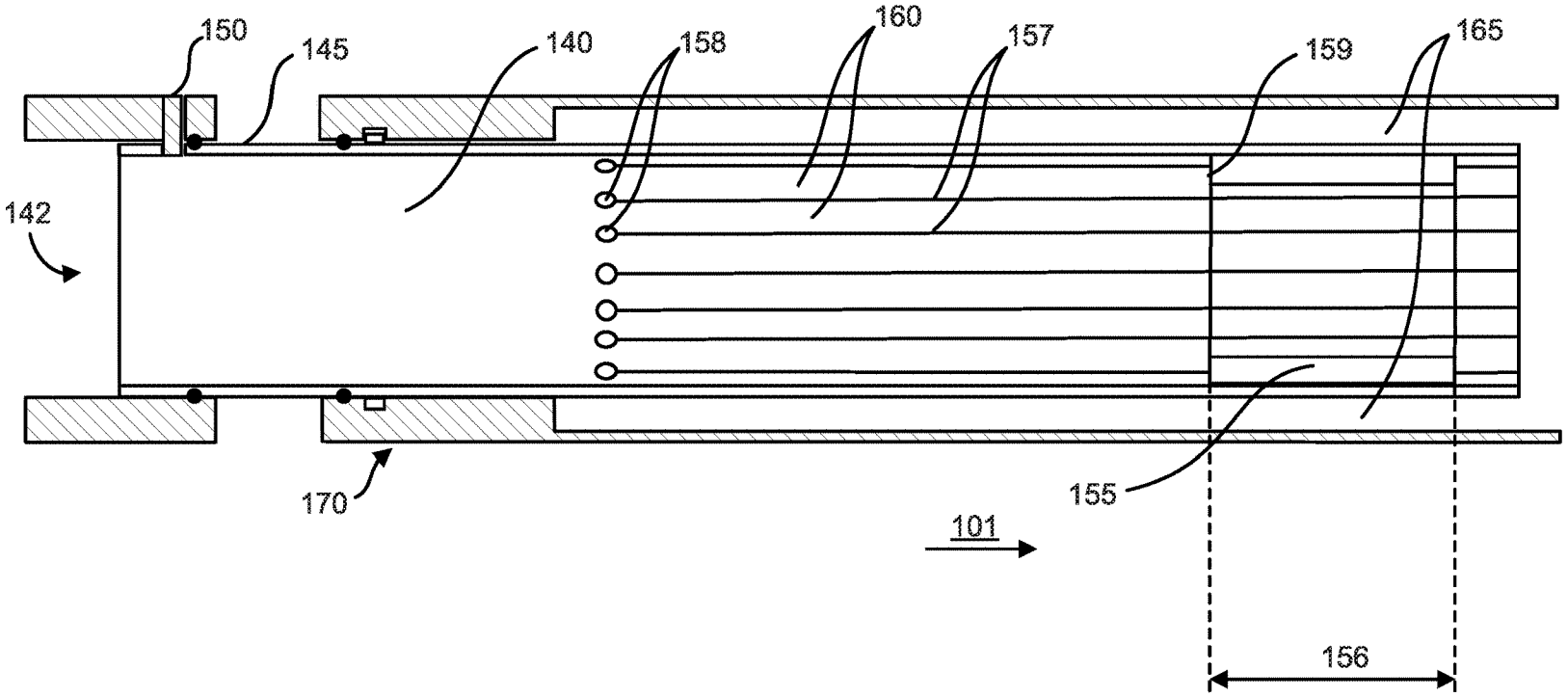
FIG. 3 illustrates, in a cross sectional view, sleeve member in accordance with an embodiment of the present invention in a casing, for interoperation with the actuation member of FIG. 2.

FIG. 2 illustrates, in cross-sectional view, an actuation member 100 (before being placed in the casing), and FIG. 3 illustrates a part of a casing 170 and a sliding sleeve member 140, provided in accordance with an embodiment of the present invention. The actuation member 100, the casing 170 and the sliding sleeve member 140 are typically of generally cylindrical shape and are located, in operation, within a wellbore. One or more ports are located at various locations along the length of the casing, which provide for fluidic communication between the borehole defined by the casing and the sidewalls of the wellbore. The fluidic communication via an exposed port facilitates hydraulic fracturing operations, in which fracking fluid is pumped downhole through the borehole and out of the exposed ports. Each of the sliding sleeve members is placed within the borehole and initially covers one or more of the ports and is movable, using a mating actuation member, so as to selectably uncover these ports.

The actuation member 100 is configured for travelling down the borehole in a longitudinal direction. The configuration includes sizing and shaping the actuation member to closely match the borehole of the casing, and placing of a plug member 105 (such as a ball) into a corresponding (e.g. tapered) plug member seat 110 of the actuation member. The plug member 105 blocks a longitudinal aperture 115 of the actuator member which, when unblocked, allows fluidic communication between an uphole end 102 of the actuation member and a downhole end 104 of the actuation member. Hydraulic fluid is applied under pressure uphole of the actuation member 100. Due to its slidability within the borehole and its size, shape and blocked longitudinal aperture 115, the actuation member 100 is motivated to move downhole under the hydraulic fluid pressure. In some embodiments, the plug member is dissolvable or otherwise removable. This provides the capability to unblock the borehole after the actuation member has engaged with and operated a sliding sleeve member to open a port in the borehole sidewall.

The actuation member 100 also includes a wedged portion 120 along a leading edge of the actuation member proximate to the downhole end 104. The wedged portion 120 is generally frustro-conical in shape and, in the presently illustrated embodiment, extends from the outer edge of the aperture 115 to a largest outer diameter of the actuation member. A groove 125 is formed at least partially circumferentially around an outer face of the actuation member 100. The groove has a first length 127 in the longitudinal direction 101. The groove 125 includes a radially oriented face 129 which is located at the uphole end of the groove. The face 129 may be, but is not necessarily radially oriented at right angles to the longitudinal direction 101. The face 129 may be oriented at an acute angle to the longitudinal direction 101 (that is, toward the downhole and in the direction of travel of the actuation member). The acute angle can be an 89 degree angle, an 85 degree angle, or another angle, e.g. smaller than 89 degrees, or between 85 degrees and 90 degrees. In another embodiment, the acute angle can be 50 degrees, or 45 to 55 degrees, or another angle, e.g. between 40 and 90 degrees. The angle and size of the face 129 is selected so that, upon engagement with a protrusion of the sliding sleeve member 140 (as described below), the protrusion will remain engaged in the groove 125 (and with the face 129) substantially without slippage. The protrusion has a similarly sized and angled mating face 159.

It is recognized herein that the radially outward protuberances formed on the actuation member disclosed in Canadian Patent Application No. 2,927,850 are prone to being caught on ledges or ridges as the actuation member travels downhole. Embodiments of the present invention address this issue at least in part by including a groove 125 on the actuation member 100 rather than a protuberance. The provision of the groove in the actuation member instead of the sliding sleeve also mitigates the problems due to the susceptibility of the grooves of the system of the '850 patent being filled and clogged with sand.

The sliding sleeve member 140 includes an aperture 142 for receiving the actuation member 100 therein. For example, the sliding sleeve member can be generally shaped as a hollow cylinder. The aperture has a diameter which is approximately the same or incrementally larger than the overall largest diameter of the actuation member 100, so that the actuation member can enter and potentially pass through the aperture 142.

The sliding sleeve member 140 initially covers a port 145 in the borehole. The port can extend partially or fully around the circumference of the casing, and multiple such ports may be provided. The sliding sleeve member 140 is fixed in place using shear pins 150 or another frangible or disengagable securing member. Once the shear pins 150 have been broken due to application of force in the longitudinal direction, the sliding sleeve member 140 is slidable within the borehole. As such, the sliding sleeve member 140 is configured, upon application of force in the longitudinal direction 101, to move downhole in the longitudinal direction, thereby uncovering the port 145. The shear pins may be rated to break under application of a rated amount of force, and hence the sliding sleeve member may be configured to move only in response to a predetermined amount of force which is at least the rated amount of force.

In some embodiments, a seal may be provided between the sliding sleeve member 140 and the casing 170. The seal is configured to seal/isolate the port 145 when the sliding sleeve member is in the closed position.

The sliding sleeve member 140 includes a deformation region and one or more inward-facing protrusions 155 connected to the sliding sleeve member in the deformation region. The protrusions 155 are biased to protrude radially into the aperture 142 so as to contact the wedged portion 120 during travel of the actuation member 100 past the protrusions 155. The protrusions 155 are movable radially outward by the wedged portion 120 of the actuation member 100 when the actuation member moves downhole past the protrusions 155.

In the presently illustrated embodiment, the deformation region of the sliding sleeve member 140 is defined by longitudinal extensions 160 extending towards downhole, wherein the protrusions 155 are located at or near ends of longitudinal extensions 160. The extensions 160 may be viewed as cantilever springs upon which the protrusions 155 are mounted. The cantilever springs are formed of a resilient material, such as metal, which applies inward biasing force to the protrusions in response to being pushed outward by the wedged portion 120 of the actuating member 100. The cantilever springs can refer to elongated, resiliently flexible bodies anchored at one end. It is noted that the borehole includes a cavity 165 which surrounds a portion of the sliding sleeve member in the vicinity of the protrusions 155. This cavity 165 provides space for outward motion of the protrusions 155 (and portions of the extensions 160). The extensions 160 can be formed by creating longitudinal cuts 157 in the cylindrical body of the sliding sleeve member 140, the cuts extending to a downhole edge 159 of the cylindrical body. The cuts also extend through an inwardly-projecting (full or partial) annulus from which the protrusions 155 are formed. Strain relief 158 can also be included to facilitate flexing of the extensions 160 as cantilever springs.

Alternative structures for holding and inwardly biasing the protrusions 155 can also be used. For example, the cuts 157 are not necessarily longitudinal and do not necessarily extend to the downhole edge 159. The cuts pass through a deformation region of the sliding sleeve member, the deformation region including the inward-facing protrusions 155 formed on an interior face of the sliding sleeve member hollow tube. Resilient material (e.g. spring steel) in the deformation region provides inward bias to the protrusions, and the cuts allow radial outward movement of the protrusions due to the wedged portion 120. Again, the borehole includes the cavity 165 to allow the radial outward movement of the protrusions. In another embodiment, the protrusions are movably housed in a cartridge placed in a hole of the sliding sleeve. The protrusions move radially, and are biased inwardly for example using coil springs, hydraulic fluid or another mechanism.

The protrusions 155 have a second length 156 in the longitudinal direction 101. In the presently illustrated case, the second length is less than or equal to the first length 127 of the groove 125 in the actuation member 100. As such, the protrusions 155 are configured, upon alignment with the groove 125 of the actuation member, to move radially inward due to the biasing force applied on the protrusions (the biasing force being generated in response to deformation of the resilient deformation region by travel of the wedged portion of the actuation member). Upon such radial inward motion, the protrusions 155 are received within the groove 125 of the actuation member 100. The protrusions and the groove are configured so that, once received, the protrusions are retained within the groove substantially without slippage that would cause the protrusions to fall out of the groove. This action is referred to as a keying action, in which only actuation members having a sufficiently long groove allow for protrusions of a given (same or shorter) length to be received in the groove.

Upon retention of the protrusions 155 within the groove 125, the radially oriented face 129 of the groove matingly engages respective radially oriented faces 159 of each of the protrusions 155. This engagement allows a transfer of the predetermined amount of force (required to slide the sliding sleeve) from the actuation member to the sleeve member. In more detail, hydraulic pressure imparts the predetermined amount of force onto the actuation member, the force is transferred via the mating faces 129, 159 onto the protrusions, and, by virtue of connection of the protrusions with the sliding sleeve member 140, the force causes shearing of the shear pins 150 and sliding of the sliding sleeve member. In some embodiments, the predetermined amount of force is at least equal to the rated shearing force of the shear pins.

It is noted that, if the second length 156 of the protrusions were greater than the first length 127 of the groove, then the protrusions would be too long to fit within the groove. In this case, the actuation member would pass through the sliding sleeve without the protrusions being received in the groove. This feature can be used to selectably pass the actuation member through other sliding sleeve members (having protrusions which are longer than the first length 127), upstream of the illustrated sliding sleeve member. This feature can also be used to selectably pass another actuation member (having a groove which is shorter than the second length 156) through the illustrated sliding sleeve member, and toward other sliding sleeve members downstream of the illustrated sliding sleeve member. A plurality of sliding sleeve members and actuation members can be provided and used within the borehole, in which different sliding sleeve members have differently-lengthed protrusions, and different actuation members have differently-lengthed grooves.

The inner diameter of the wedged portion may be smaller than the diameter defined by the inner edges of the protrusions 155, so as to reduce shock when the wedged portion contacts the protrusions.

The depth of the groove is generally sufficient for holding at least part of the protrusions 155 without slippage, overstressing of the springs, etc.

In some embodiments, rather than or in addition to providing a resilient deformation region of the sliding sleeve member (which allows the protrusions on the sliding sleeve member to be pushed outward by the wedged portion of the actuation member), the actuation member itself can be resiliently deformable in the radial inward direction. A portion of the actuation member which is resiliently deformable may also be referred to as a (resilient) deformation region. In some embodiments, the deformation region of the actuation member is the trailing portion of the actuation member. The deformation region of the actuation member may be colleted and includes the actuation member groove. Longitudinal cuts (collets) can be formed within a resilient material forming the (hollow) actuation member in order to allow the actuation member to be radially inwardly compressible in response to force imparted on the wedged portion by the protrusions (of the sliding sleeve member) when the actuation member moves downhole past the protrusions. It is noted that a variety of design options are available in which: a portion of the sliding sleeve member radially outwardly deforms while the actuation member remains undeformed; the actuation member radially inwardly deforms while the sliding sleeve member remains undeformed; or both the portion of the sliding sleeve member radially outwardly deforms and the actuation member radially inwardly deforms.

Figure 4A:
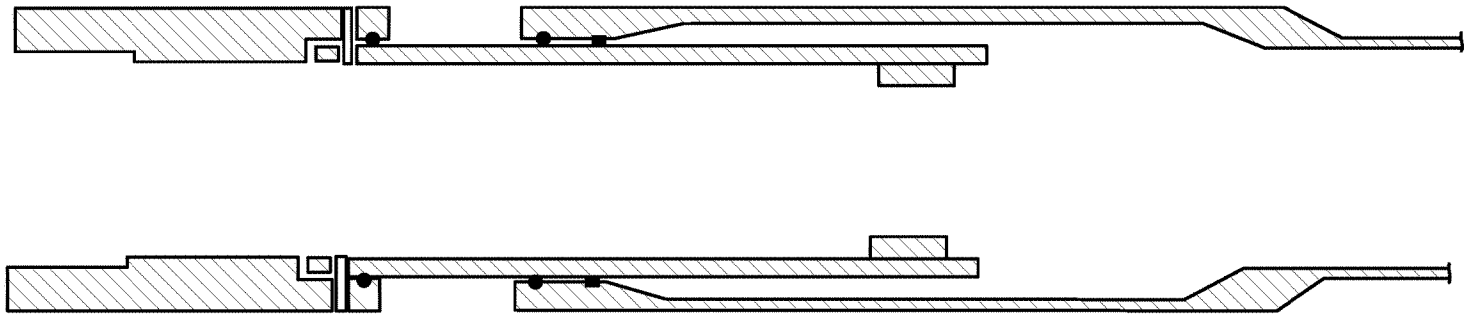
FIGS. 4A to 4F illustrate, in sectional views, operation of an actuation member with respect to the casing, in accordance with an embodiment of the present invention.
Figure 4B:
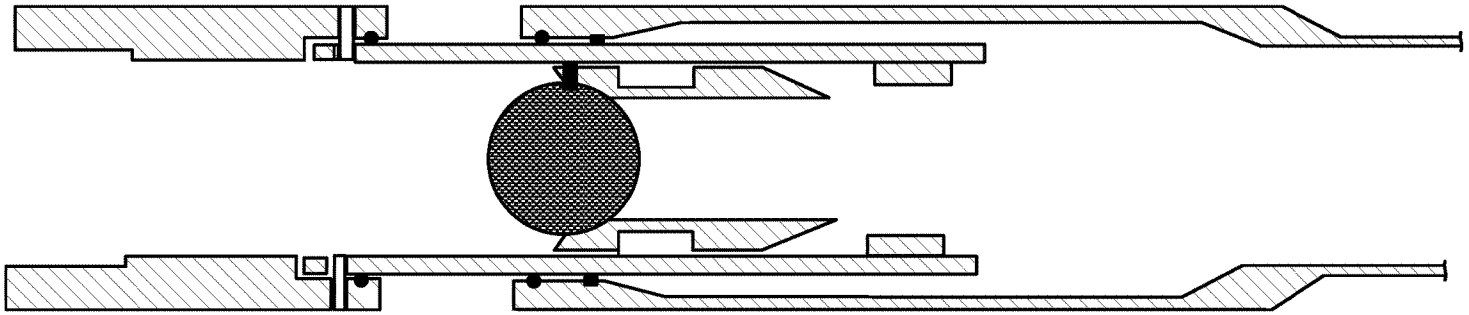
Figure 4C:
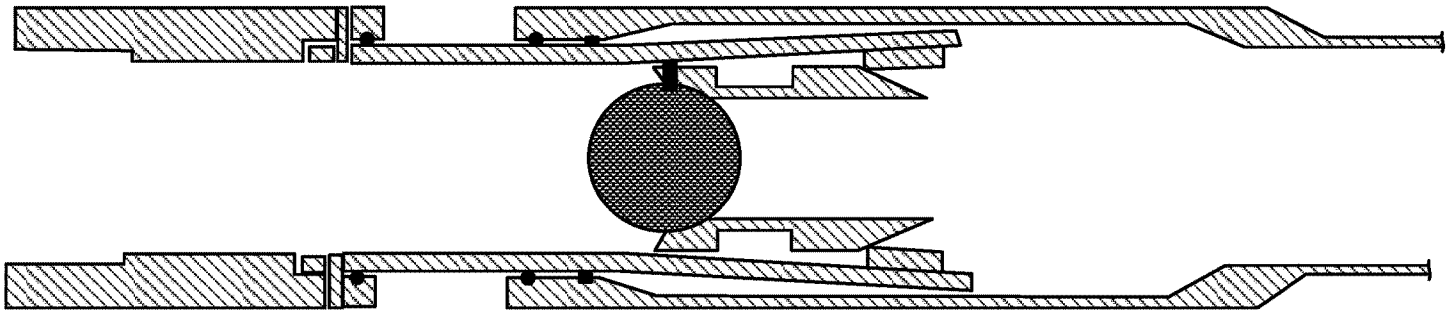
Figure 4D:
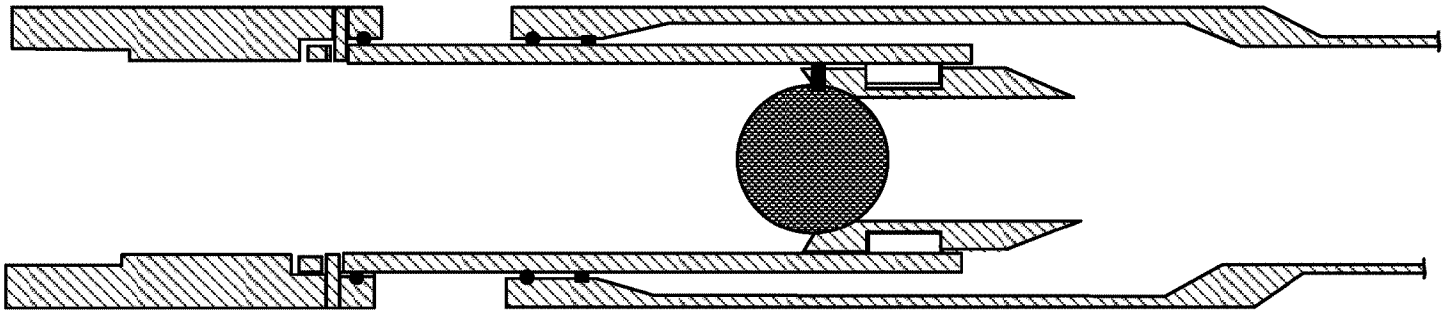
Figure 4E:
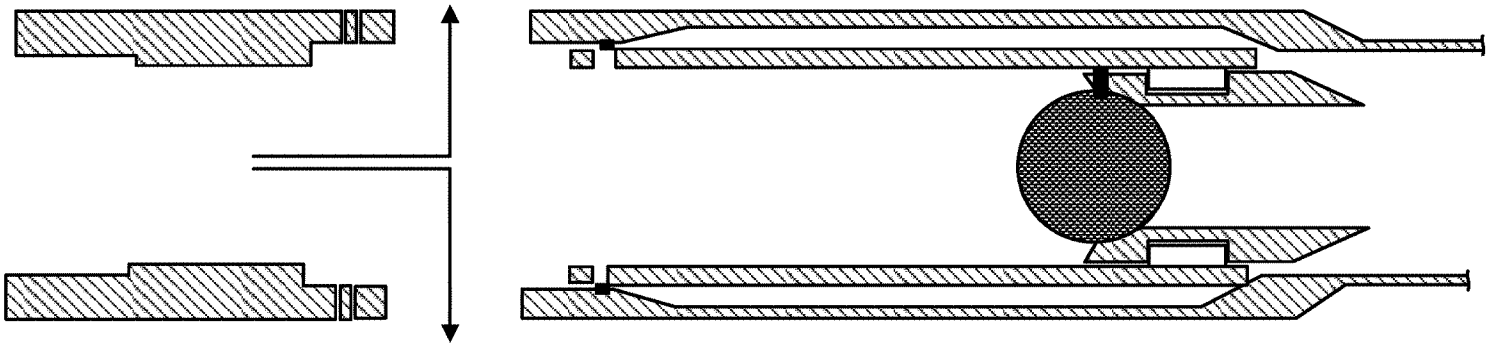
Figure 4F:
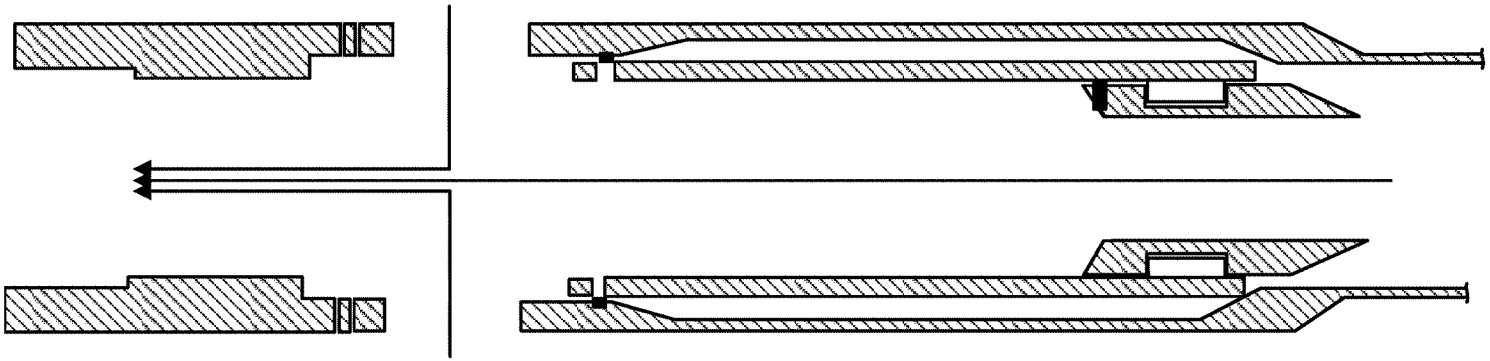

FIGS. 4A to 4F, illustrate the operation of an actuation member to move a mating sliding sleeve member downhole in order to uncover ports in the casing. In FIG. 4A, the sliding sleeve member initially covers the ports. In FIG. 4B, the actuation member enters the aperture of the sliding sleeve member and approaches the protrusions. In FIG. 4C, the wedged portion of the actuation member has engaged the protrusions in order to spread the protrusions radially outward and build a biasing force therein. In FIG. 4D, the protrusions of the sliding sleeve member have engaged the groove of the actuation member, the protrusions having been pressed into the groove due to the biasing force. In FIG. 4E, the sliding sleeve member has moved downhole to uncover the ports, due to hydraulic pressure applied uphole of the engaged actuation member. It is noted that the shear pins have been broken under force to allow this movement. In FIG. 4F, the plug member held by the actuation member has been removed (e.g. dissolved), in order to allow fluid flow past the sliding sleeve member.

In various embodiments, a C-ring or other one-way-motion or locking mechanism is provided with the sliding sleeve member and configured to retain the sliding sleeve member in the downhole (open) position once the sliding sleeve member has been moved so as to uncover the ports.

In various embodiments, an anti-rotation mechanism, such as a pin-and-groove mechanism, is provided between the sliding sleeve member and the casing. The anti-rotation mechanism inhibits rotation of the sliding sleeve member. This may be useful for example when the sliding sleeve member or aperture thereof is being milled out.

Figures 5A, 5B, 5C:
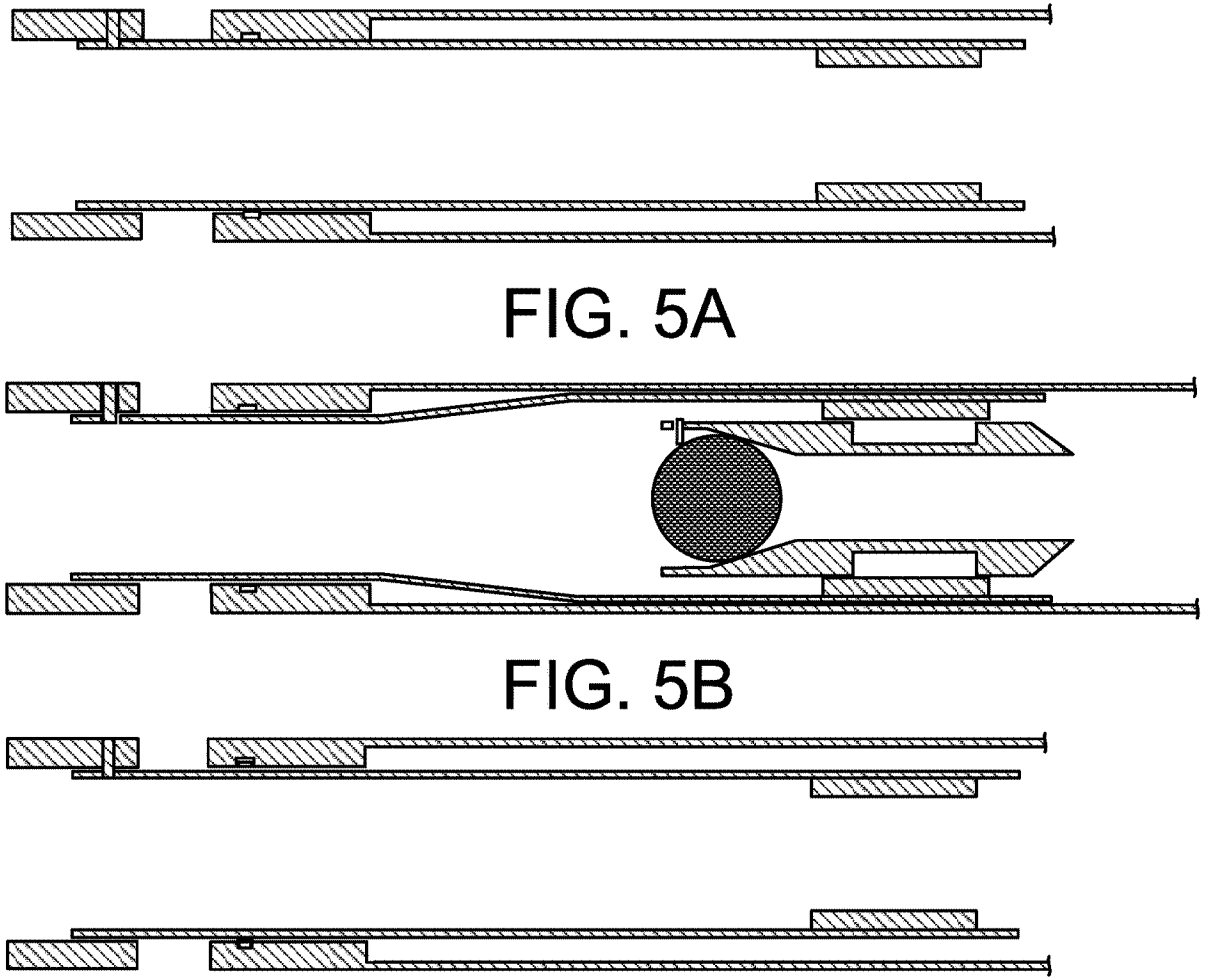
FIGS. 5A to 5C illustrate, in sectional views, operation of a sleeve member with respect to the casing, in accordance with an embodiment of the present invention.

FIGS. 5A to 5C illustrate operation of a sliding sleeve member to allow a non-mating actuation member to pass through the aperture thereof, for example in order to actuate another sliding sleeve member downhole. In FIG. 5A, the sliding sleeve member covers the ports. In FIG. 5B, the actuation member has operated to spread the protrusions radially outward to allow passage of the actuation member therebetween. Although the protrusions are thereby biased radially inward, the length of the groove is insufficient to accommodate the entire length of the protrusion. As such, the protrusion is inhibited from being fully received within the groove and further hydraulic pressure causes the actuation member to exit the aperture of the sliding sleeve member. FIG. 5C illustrates the sliding sleeve member, still covering the ports and with the deformation region returned to its original shape, after passage of the non-mating actuation member. (FIG. 5C is identical to FIG. 5A).

Another embodiment of the present invention will now be described with respect to FIGS. 6 to 7B. In this embodiment, with reference to FIG. 6, the actuation member includes a leading portion 610 and a trailing portion 640. When the actuation member moves in the downhole direction, the leading portion 610 is received within the sliding sleeve member aperture first, followed by the trailing portion 640. The trailing portion 640 is resiliently deformable and includes the groove 650, also referred to as a radial keyway.

The leading portion 610 has an outer diameter which is smaller than the distance between opposing inward-facing protrusions associated with the sliding sleeve member. The leading portion can thus pass between the protrusions without necessarily requiring a deformation of either the sliding sleeve member or the actuation member.

In the present illustrated embodiment, the trailing portion 640 also includes a wedged portion 645. The wedged portion 645 protrudes from the outer surface of the actuation member at a location between a leading edge and a trailing edge of the actuation member. As such, the wedged portion is not necessarily located at the actuation member leading edge. The wedged portion includes a face which protrudes from the actuation member at an angle lying between the radial outward direction and the uphole (i.e. opposite to downhole) direction. The wedged portion 645 is located on the actuation member so as to contact the protrusions (of the sliding sleeve member) prior to alignment of the protrusions and the groove 650, when the actuation member travels in the downhole direction. As such, the wedged portion can cause initial spreading of the protrusions. This may bias the protrusions radially inward in various embodiments, due to resiliently deformable features of the sleeve member holding the protrusions.

Resilient deformation of the trailing portion 640 (due to contact with the sliding sleeve member protrusions with the wedged portion 645) is facilitated by construction from a resilient material, such as spring steel, along with the presence of a plurality of longitudinal cuts or gaps 655 which segment the trailing portion 640 into a plurality of collets 642, also referred to as cantilever spring sections. These portions can be deformed, resulting in inward deformation of the trailing portion 640.

Figure 6:
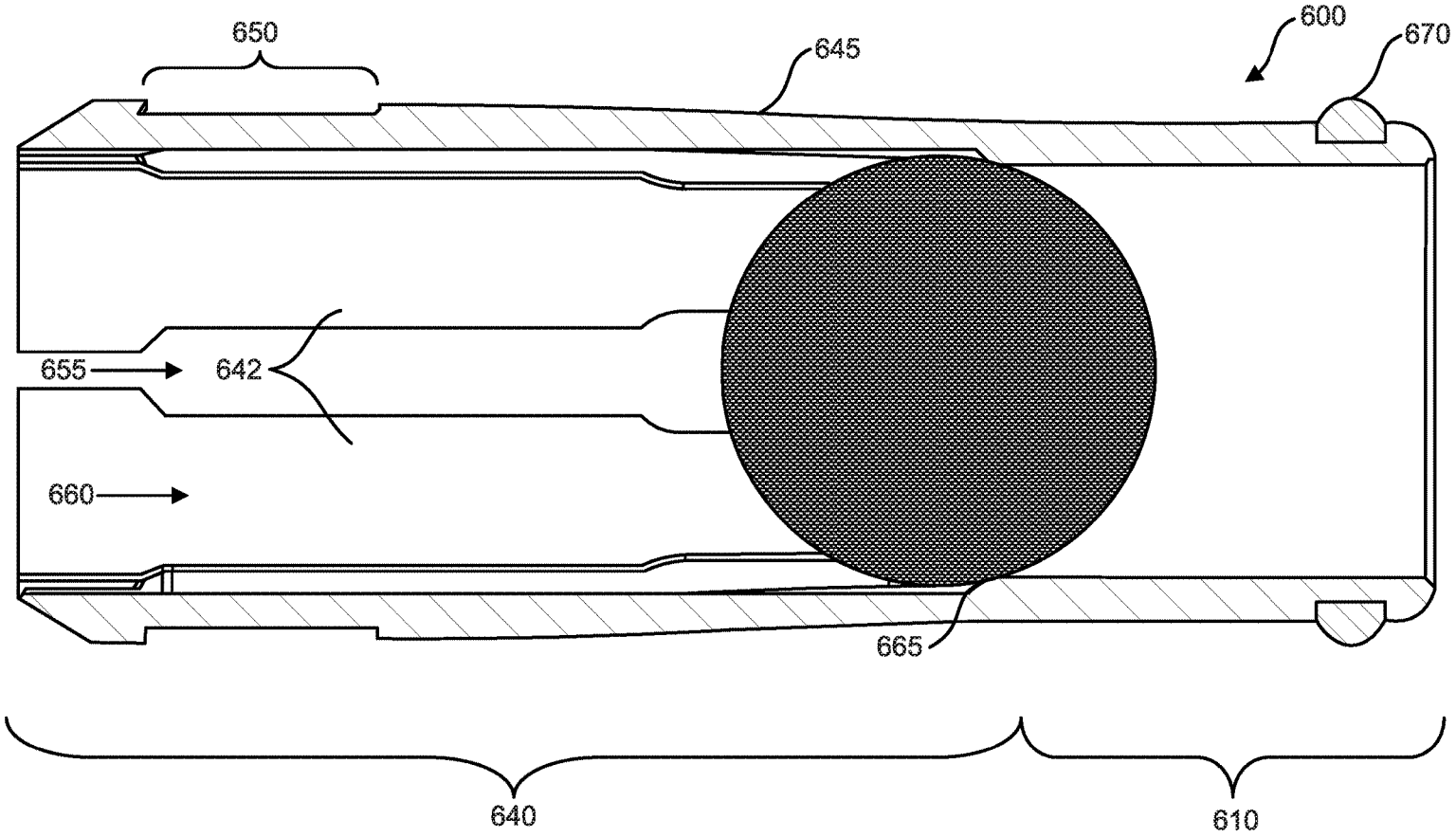
FIG. 6 illustrates aspects of an actuation member provided in accordance with another embodiment of the present invention.

FIG. 6 also illustrates a longitudinal aperture 660 extending from an uphole face (trailing edge) of the actuation member to a downhole face (leading edge) of the actuation member, and a plug member seat 665 within the aperture 660. The plug member seat 665 is provided as a narrowing of the aperture 660, and is configured for receiving and retaining a plug member for blocking the longitudinal aperture. The plug member may be controllably dissolvable and may be ball-shaped. FIG. 6 also illustrates a seal 670 which slidingly engages with the sliding sleeve member inner sidewall.

Figure 7A:
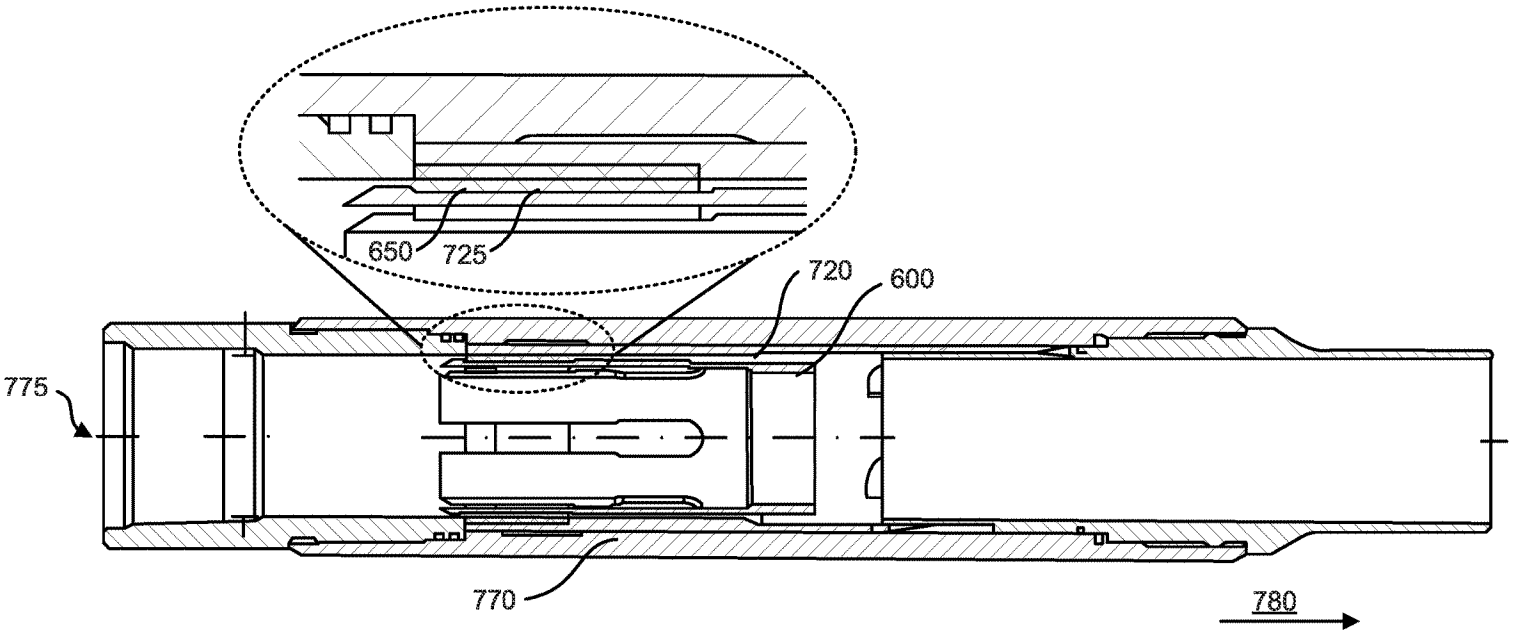
FIGS. 7A to 7B illustrate, in sectional views, operation of a sleeve member with respect to the casing when actuated by the actuation member of FIG. 6, in accordance with an embodiment of the present invention.
Figure 7B:
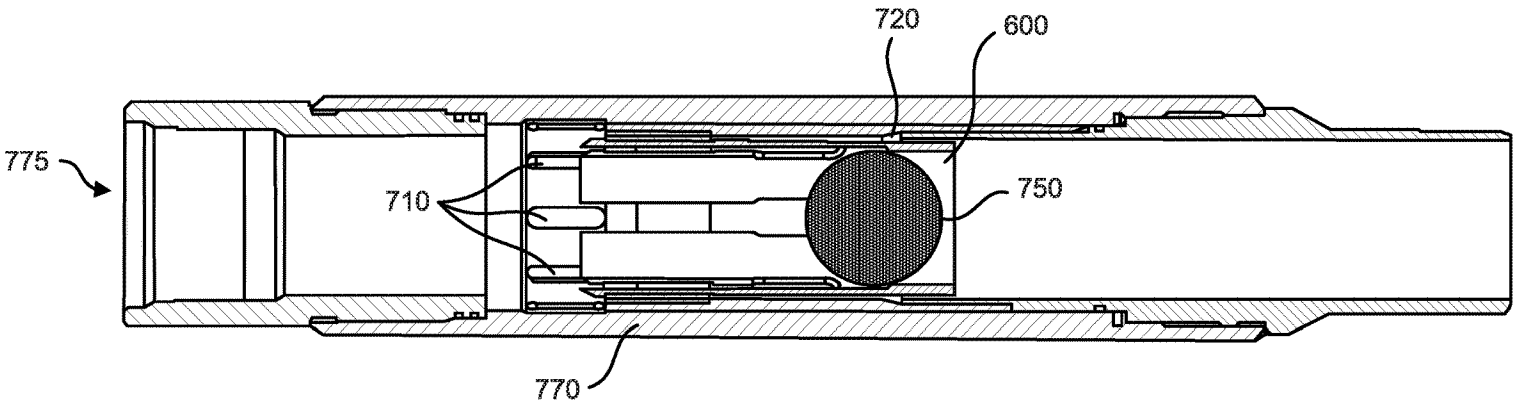

FIGS. 7A and 7B illustrate, in sectional views, the actuation member 600 of FIG. 6 in the process of actuating a sleeve member 720. FIG. 7A illustrates the actuation member 600 upon its initial engagement of the sliding sleeve member, when the ports in the casing are covered by the sliding sleeve member. The protrusions of the sliding sleeve member are received within the groove of the actuation member. An enlarged detail in FIG. 7A shows the mating of the protrusion 725 of the sleeve member and the groove 650 of the actuation member. FIG. 7B illustrates the sliding sleeve member after it has been moved downhole by the actuation member to uncover the ports 710. FIG. 7B further illustrates the plug member 750 seated in the plug member seat.

The casing 770, borehole 775, and downhole direction 780 are also shown in FIGS. 7A and 7B for clarity. The sliding sleeve member may be substantially undeformed in the radial direction during passage of the actuation member. Alternatively, both the trailing portion of the actuation member and the sliding sleeve member may be radially deformable.

Although not shown in the present embodiment, the leading edge of the actuation member can optionally be inwardly tapered, e.g. wedge-shaped, to mitigate the potential for the leading edge to become undesirably caught on an inwardly protruding body in the borehole.

In some embodiments, because the leading portion 610 of the actuation member 600 is received within the sliding sleeve member aperture first, the actuation member is made to align more closely with the sliding sleeve member aperture. That is, the central longitudinal axis of the actuation member is more closely aligned with the central longitudinal axis of the sliding sleeve member aperture. This can lead to smoother operation.

In some embodiments, because the ball seat plug 665 is located downhole from the trailing portion 640 of the actuation member 600, the downhole force on the actuation member is applied (by the plug member) at a location which is downhole from the trailing member 640 during its engagement with the sliding sleeve member. Thus, the actuation member is pulled rather than pushed through the sliding sleeve member aperture. This can result in more stable operation.

Figure 8A:
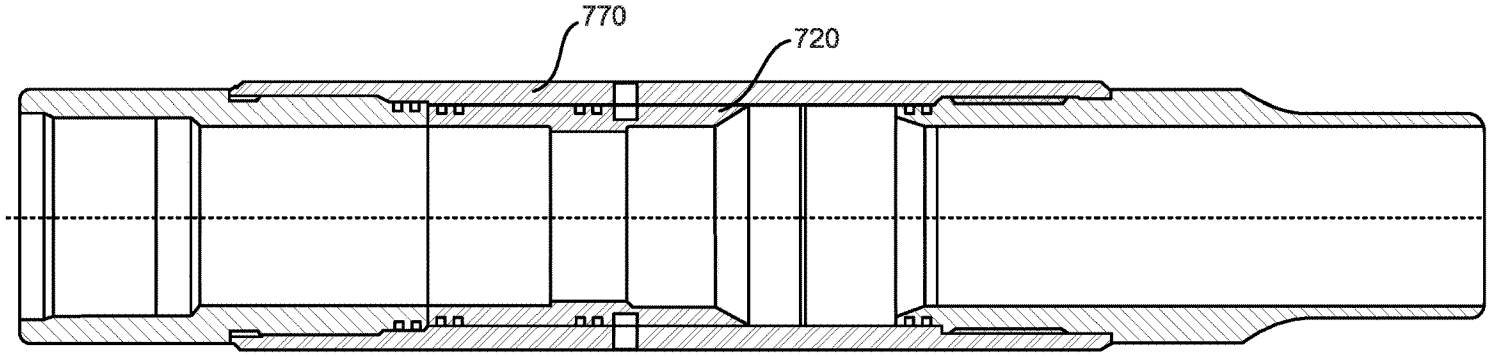
FIGS. 8A to 8F illustrate, in sectional views, further details of the operation of a sleeve member with respect to the casing when actuated by the actuation member of FIG. 6, in accordance with an embodiment of the present invention.
Figure 8B:
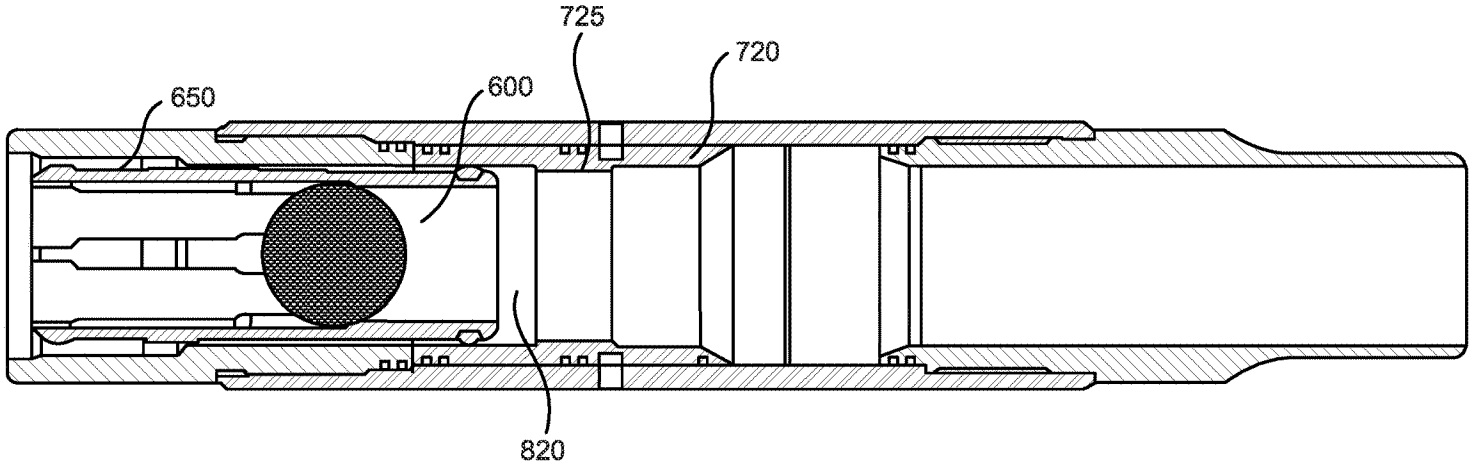
Figure 8C:
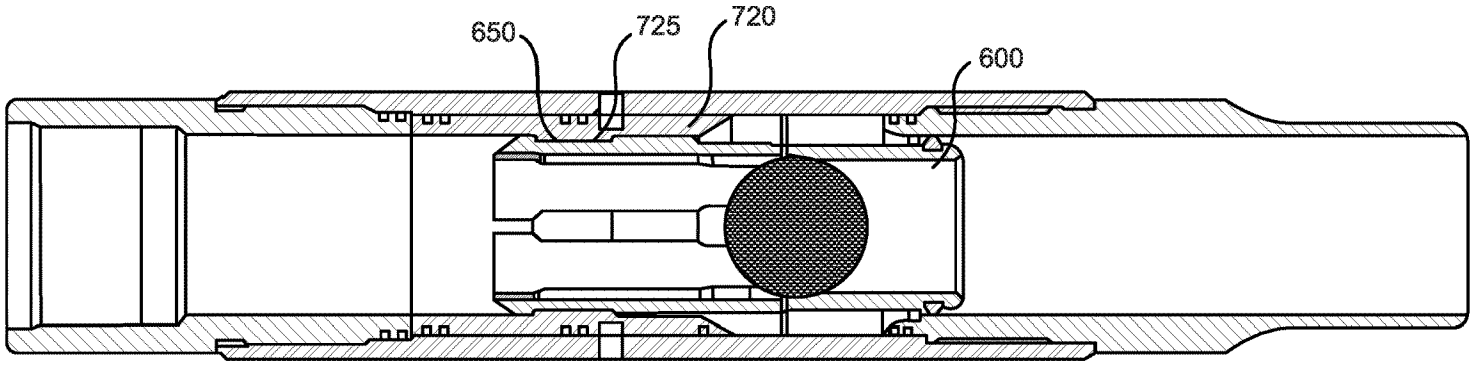
Figure 8D:
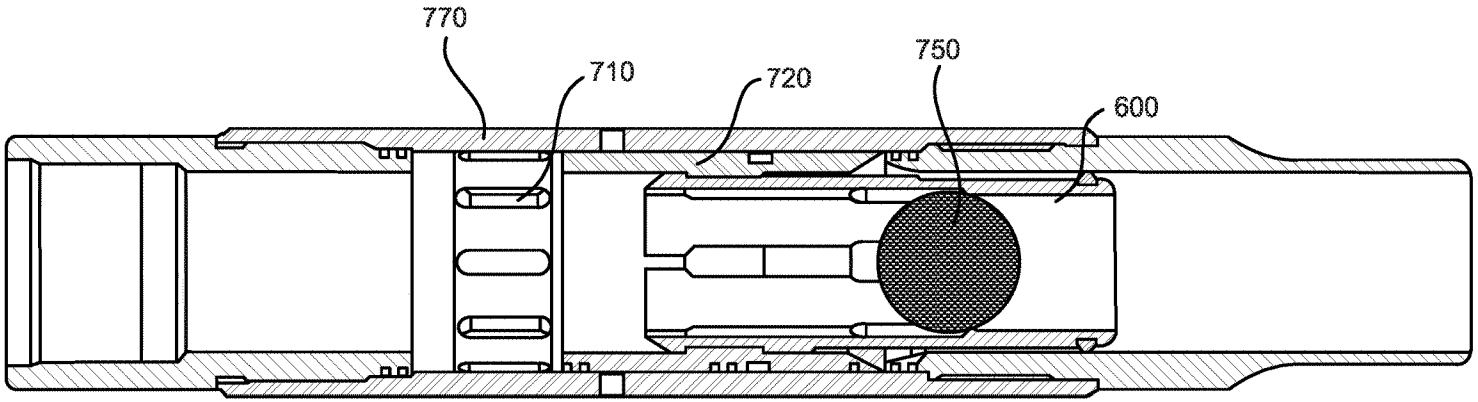
Figure 8E:
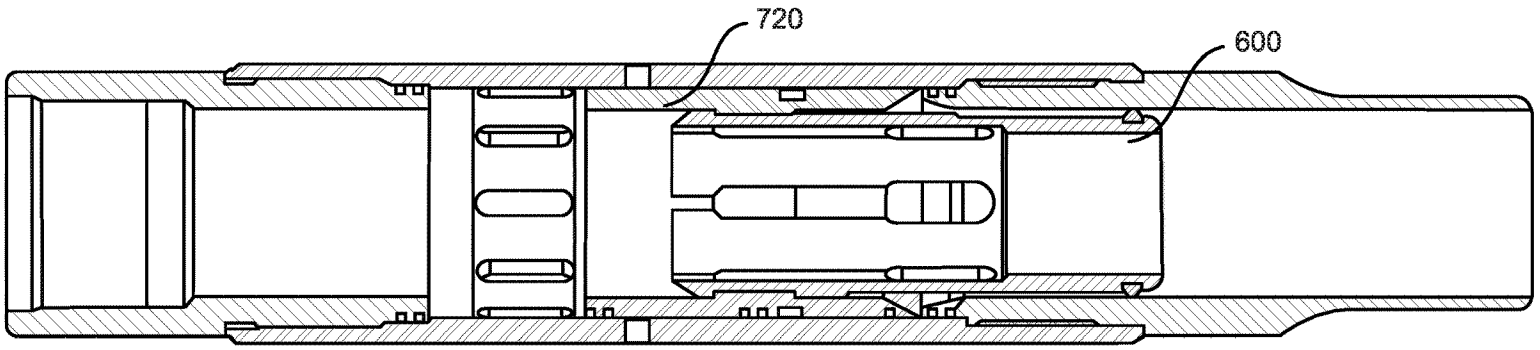
Figure 8F:
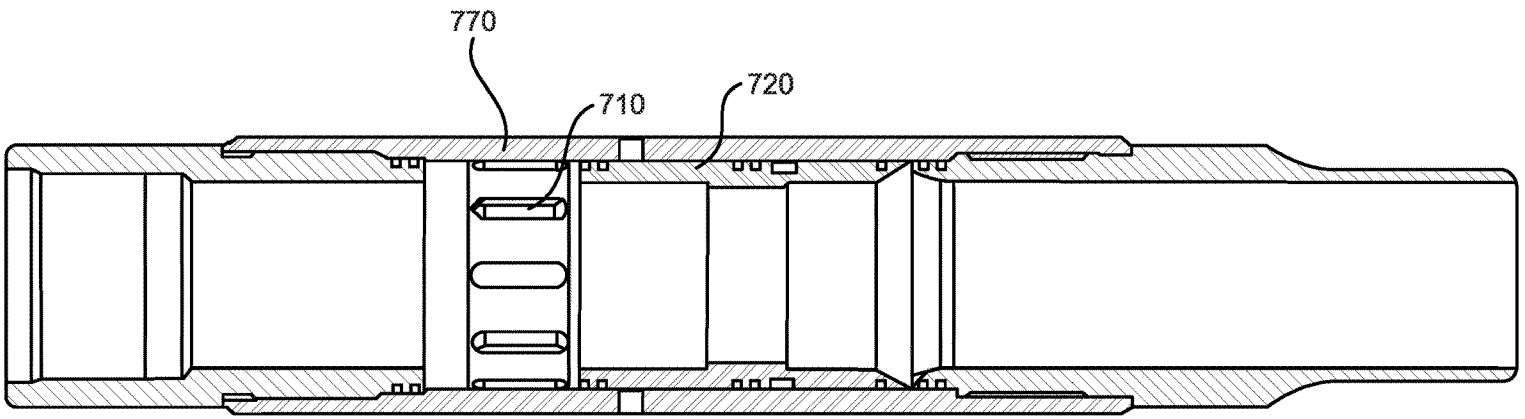

FIGS. 8A to 8F illustrate, in sectional views, further details of the operation of a sleeve member with respect to the casing when actuated by the actuation member of FIG. 6, in accordance with an embodiment of the present invention. FIGS. 8A to 8D are illustrated in sequence corresponding to downhole motion of the actuation member. FIGS. 8E and 8F illustrate different potential subsequent configurations.

FIG. 8A illustrates the sliding sleeve member 720 disposed in the casing prior to actuation by the actuation member, and in which the sliding sleeve member covers ports in the casing 770. FIG. 8B illustrates the actuation member 600 as it enters the aperture 820 defined by the sliding sleeve member 720, but prior to the protrusions 725 of the sliding sleeve member being received within the groove 650 of the actuation member.

FIG. 8C illustrates mating engagement of the actuation member 600 and the sliding sleeve member 720, in which the protrusions 725 of the sliding sleeve member have been received within the groove 650 of the actuation member. In FIG. 8C, the sliding sleeve member has not yet been moved downhole due to force applied via the actuation member.

FIG. 8D illustrates configuration of the sliding sleeve member 720 after it has been moved downhole by hydraulic force applied via the actuation member 600, so as to uncover the ports 710 in the casing 770 surrounding the sliding sleeve member. The actuation member is still engaged with the sliding sleeve member at this time. The plug member 750 is present within the actuation member.

FIG. 8E illustrates the same configuration as FIG. 8D, but with the plug member removed. The plug member may have been removed by dissolving, for example. In this configuration, fluid can move past the actuation member 600 following actuation of the sliding sleeve member 720.

FIG. 8F illustrates a configuration in which the sliding sleeve member 720 has been moved downhole so as to uncover the ports 710 in the surrounding casing 770, but in which the actuation member is not present. The actuation member may have been released by a release mechanism and moved downhole or uphole away from the sliding sleeve member (e.g. with the plug member still present). A potential release mechanism is to apply a larger downhole force via hydraulic fluid to the actuation member, thereby causing it to release from its mating engagement with the sliding sleeve member. Alternatively, the actuation member may be made of a material which dissolves in a certain type of fluid, and removal of the actuation member may comprise introducing this fluid into the borehole to dissolve the actuation member. Alternatively, FIG. 8F can be regarded as a simplified view with the actuation member not illustrated for clarity.

As used herein, the "present disclosure" or "present invention" refer to any one of the embodiments described herein, and any equivalents. Furthermore, reference to various aspects of the invention throughout this document does not mean that all claimed embodiments or methods must include the referenced aspects or features.

It should be understood that any of the foregoing configurations and specialized components or may be interchangeably used with any of the apparatus or systems of the preceding embodiments. Although illustrative embodiments are described hereinabove, it will be evident to one skilled in the art that various changes and modifications may be made therein without departing from the scope of the disclosure. It is intended in the appended claims to cover all such changes and modifications that fall within the true spirit and scope of the disclosure.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A system for controllably exposing selected locations along a wellbore to a pressurized fluid, the wellbore including an elongated casing disposed therein, the casing defining an internal borehole extending longitudinally with the wellbore, the casing having one or more ports extending through the casing, the system comprising:

an actuation member configured for travelling down the borehole in a longitudinal direction, the actuation member including a wedged portion and a groove formed at least partially circumferentially around an outer surface of the actuation member, the groove having a first length in the longitudinal direction;

a first sliding sleeve member for disposal within the borehole and having an aperture for receiving the actuation member therein, the first sliding sleeve member configured to initially cover one of the one or more ports, and further configured to move downhole in response to force in the longitudinal direction to uncover the port; and one or more inward-facing protrusions connected to the first sliding sleeve member, the protrusions at least initially protruding radially into the aperture, the protrusions having a second length in the longitudinal direction, the second length being less than or equal to the first length, one or both of the protrusions and the groove configured, upon alignment of the protrusions and the groove, to move radially toward the other due to a biasing force so that the protrusions are received within the groove, whereupon the predetermined amount of force is transferred from the actuation member to the sleeve member, wherein one or both of the actuation member and the first sliding sleeve have a deformation region, wherein the deformation region of the first sliding sleeve has the one or more inward facing protrusions; wherein the biasing force is generated by one or both of: resilient radial outward deformation of the deformation region of the first sliding sleeve member, and resilient radial inward deformation of the actuation member, said resilient radial outward and inward deformation occurring in response to action of the wedged portion on the protrusions during downhole motion of the actuation member past the protrusions.

2. The system of claim 1, wherein the one or more inward-facing protrusions are movable radially outward by the wedge of the actuation member when the actuation member moves downhole past the one or more inward-facing protrusions.

3. The system of claim 1, wherein the actuation member remains undeformed during downhole motion past the one or more inward-facing protrusions.

4. The system of claim 1, wherein the actuation member is compressible radially inwardly due to force applied by the one or more inward-facing protrusions on the wedged portion when the actuation member moves downhole past the one or more inward-facing protrusions.

5. The system of claim 4, wherein the first sliding sleeve member remains undeformed and the one or more inward-facing protrusions remain stationary during downhole motion of the actuation member past the one or more inward-facing protrusions.

6. The system of claim 1, further comprising:

a second sliding sleeve member for disposal within the borehole uphole of the first sliding sleeve member, the second sliding sleeve member having a second aperture for receiving the actuation member therein, the second sliding sleeve member initially covering a second port extending through the casing and configured, upon application of a second predetermined amount of force applied in the longitudinal direction, to move downhole in the longitudinal direction, thereby uncovering the second port; and one or more second inward-facing protrusions connected to the second sliding sleeve member, the one or more second inward-facing protrusions biased to protrude radially into the second aperture, the one or more second inward-facing protrusions movable radially outward by the wedged portion of the actuation member when the actuation member moves downhole, or the actuation member being radially inwardly compressed by action of the one or more second inward-facing protrusions on the wedge when the actuation member moves downhole, or both, the one or more second inward-facing protrusions having a third length in the longitudinal direction, the third length being greater than the first length, the one or more second inward-facing protrusions and the groove thereby configured to refrain from moving radially toward one another during passage of the actuation member between the one or more second inward-facing protrusions, thereby allowing passage of the actuation member past the second sliding sleeve member without imparting the second predetermined amount of force thereto.

7. The system of claim 6, further comprising a second actuation member configured for travelling down the borehole in the longitudinal direction, the second actuation member including a second wedged portion and a second groove formed at least partially circumferentially around a second outer face of the second actuation member, the second groove having a fourth length in the longitudinal direction, the fourth length being greater than or equal to the third length of the one or more second inward-facing protrusions, one or both of the one or more second inward-facing protrusions and the second groove configured, upon alignment of the one or more second inward-facing protrusions and the second groove, to move radially toward the other due to a second biasing force so that the one or more second inward-facing protrusions are received within the second groove, whereupon a second radially oriented face of the second groove engages respective radially oriented faces of each of the one or more second inward-facing protrusions to transfer the second predetermined amount of force from the second actuation member to the second sleeve member, wherein the second biasing force is generated by one or both of: resilient radial outward deformation of a second deformation region of the second sliding sleeve member, the second deformation region including the one or more second inward-facing protrusions; and resilient radial inward deformation of the second actuation member, said resilient radial outward and inward deformation occurring in response to action of the second wedged portion on the one or more second inward-facing protrusions during downhole motion of the second actuation member past the one or more second inward-facing protrusions.

8. The system of claim 1, wherein the actuation member includes a longitudinal aperture extending from an uphole face of the actuation member to a downhole face of the actuation member, and a plug member seat within the longitudinal aperture, the plug member seat configured for receiving and retaining a plug member for blocking the longitudinal aperture.

9. The system of claim 8, wherein the plug member is controllably dissolvable.

10. The system of claim 1, wherein the first sliding sleeve further comprises one or more longitudinal cantilever springs, each of the one or more inward-facing protrusions mounted on a respective one of the cantilever springs, and the cantilever springs applying said bias to the protrusions, and wherein the borehole comprises a cavity radially outward from the cantilever springs to allow said radial outward movement of the one or more inward-facing protrusions.

11. The system of claim 1, wherein the first sliding sleeve comprises a hollow tube having a deformation region formed of a resilient material and having one or more longitudinal cuts formed therein, the deformation region having the one or more inward-facing protrusions formed on an interior face of the hollow tube, the resilient material providing said bias to the protrusions, and the one or more longitudinal cuts allowing said radial outward movement of the one or more inward-facing protrusions, and wherein the borehole comprises a cavity radially outward from the deformation region to allow said radial outward movement of the one or more inward-facing protrusions.

12. The system of claim 1, wherein the actuation member initially substantially fills the borehole and travels down the borehole in response to hydraulic pressure applied uphole of the actuation member.

13. The system of claim 1, wherein the radially oriented face of the groove forms an angle with the longitudinal direction, toward the downhole, of between 55 degrees and 90 degrees.

14. The system of claim 1, wherein the sliding sleeve member is initially fixed in place using shear pins which are configured to break upon application of a predetermined amount of force.

15. The system of claim 1, wherein the wedged portion is located on the actuation member so as to contact the protrusions prior to said alignment of the protrusions and the groove when the actuation member travels in the downhole direction.

16. The system of claim 1, wherein the wedged portion is located along a leading edge of the actuation member.

17. The system of claim 1, wherein the wedged portion protrudes from the outer surface of the actuation member at a location between a leading edge and a trailing edge of the actuation member.

18. The system of claim 1, wherein the actuation member includes a leading portion and a trailing portion, the leading portion located downhole of the trailing portion, and wherein the trailing portion is compressible radially inwardly due to force applied by the one or more inward-facing protrusions on the wedged portion when the actuation member moves downhole past the one or more inward-facing protrusions.

19. The system of claim 18, wherein the trailing portion comprises resiliently deformable collets actuated for radially inward compression.

20. The system of claim 18, wherein the actuation member includes a longitudinal aperture extending from an uphole face of the actuation member to a downhole face of the actuation member, and wherein the leading portion comprises a plug member seat within the longitudinal aperture, the plug member seat configured for receiving and retaining a plug member for blocking the longitudinal aperture and receiving a downhole hydraulic force for propelling the actuation member.

* * * * *